US007857074B2

(12) United States Patent
Meixner

(10) Patent No.: US 7,857,074 B2
(45) Date of Patent: Dec. 28, 2010

(54) HAND-HELD POWER TOOL WITH A PERCUSSION UNIT

(75) Inventor: Gerhard Meixner, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 116 days.

(21) Appl. No.: 12/097,147

(22) PCT Filed: May 11, 2007

(86) PCT No.: PCT/EP2007/054578

§ 371 (c)(1),
(2), (4) Date: Jun. 12, 2008

(87) PCT Pub. No.: WO2008/006634

PCT Pub. Date: Jan. 17, 2008

(65) Prior Publication Data

US 2009/0008114 A1 Jan. 8, 2009

(30) Foreign Application Priority Data

Jul. 12, 2006 (DE) ..... 10 2006 032 214

(51) Int. Cl.
*E02D 7/02* (2006.01)

(52) U.S. Cl. ..... 173/48; 173/93; 173/112; 173/216

(58) Field of Classification Search ..... 173/47, 173/48, 41, 90, 93.6, 93.7, 94, 110, 112, 173/216
See application file for complete search history.

(56) References Cited

U.S. PATENT DOCUMENTS

| | | | | |
|---|---|---|---|---|
| 4,719,976 | A * | 1/1988 | Bleicher et al. | 173/109 |
| 4,770,254 | A * | 9/1988 | Kominami | 173/109 |
| 5,379,848 | A * | 1/1995 | Rauser | 173/48 |
| 5,678,641 | A * | 10/1997 | Manschitz et al. | 173/114 |
| 6,035,945 | A * | 3/2000 | Ichijyou et al. | 173/48 |
| 6,109,364 | A * | 8/2000 | Demuth et al. | 173/48 |
| 6,112,830 | A * | 9/2000 | Ziegler et al. | 173/109 |
| 6,131,671 | A * | 10/2000 | Shibata et al. | 173/48 |
| 6,675,911 | B2 * | 1/2004 | Driessen | 173/216 |
| 6,978,847 | B2 | 12/2005 | Buchholz | |
| 2002/0134563 | A1 * | 9/2002 | Stirm | 173/201 |

FOREIGN PATENT DOCUMENTS

| | | |
|---|---|---|
| DE | 203 01 079 | 5/2003 |
| EP | 1 000 712 | 5/2000 |
| EP | 1 413 401 | 4/2004 |
| EP | 1 618 999 | 1/2006 |
| JP | 63185506 | 8/1988 |

* cited by examiner

*Primary Examiner*—Paul R Durand
(74) *Attorney, Agent, or Firm*—Michael J. Striker

(57) ABSTRACT

The invention is based on a power hand tool, in particular a hammer drill and/or hammer chisel, with a percussion unit (10), which comprises a tumble bearing unit (12) with a tumble body (14) and also a piston (16). It is proposed that the power hand tool comprises at least two bearing locations (18, 20; 22, 24) arranged in parallel in the force of flux, by means of which the tumble body (14) is coupled to the piston (16).

2 Claims, 3 Drawing Sheets

HAND-HELD POWER TOOL WITH A PERCUSSION UNIT

CROSS-REFERENCE TO A RELATED APPLICATION

The invention described and claimed hereinbelow is also described in German Patent Application DE 10 2006 032 214.2 filed on Jul. 12, 2006. This German Patent Application, whose subject matter is incorporated here by reference, provides the basis for a claim of priority of invention under 35 U.S.C. 119(a)-(d).

BACKGROUND OF THE INVENTION

The present invention relates to a hand-held power tool with a percussion unit.

Hand-held power tools—in particular rotary hammers and chisel hammers—that include a percussion unit and a wobble bearing unit with a wobble body and a piston are already known. The wobble body includes a wobble finger, which is coupled with the piston at a single bearing point.

SUMMARY OF THE INVENTION

The present invention is directed to a hand-held power tool, in particular a rotary hammer and/or chisel hammer, with a percussion unit that includes a wobble bearing unit with a wobble body and a piston.

It is provided that the hand-held power tool includes at least two and preferably at least three bearing points, which are connected in parallel in the power flow, via which the wobble body is coupled with the piston, and/or which are provided to transfer a drive motion from the wobble body to the piston. A "percussion unit" refers, in particular, to a unit that is provided to convert a rotary motion into a translatory percussion motion. A "wobble bearing unit" refers, in particular, to a unit with which, due to a wobble body supported obliquely in a bearing element, a wobbling motion of the wobble body results when the bearing element rotates. In addition, "connected in parallel in the power flow" refers, in particular, to a configuration in which a force to be transferred is distributed to the bearing points. Using a related inventive embodiment, various necessary compensation motions and/or drive forces that are produced may be advantageously distributed among several bearing points. The bearings that form the bearing points may be designed with thinner dimensions that a single bearing, and they may be integrated in a housing unit in a particularly flexible and space-saving manner. The wobble body may be coupled with the piston directly or, preferably, via intermediate components.

In particular, the overall length may be reduced when at least one bearing point is located next to the piston. If at least two bearing points are located next to the piston, it is also possible to realize an advantageous introduction of force that is at least largely symmetrical. "Next to" is understood to mean above the piston, below the piston, and, in particular, next to the piston, on the side.

In a further embodiment of the present invention it is provided that the wobble bearing unit includes a swivel body that is coupled with the wobble body. A "wobble body" refers, in particular, to a body that is supported such that it may swivel about a swivel axis, and that, in particular, may move relative to the wobble body. Using an appropriate design, it is possible, in particular, to advantageously distribute compensation motions among various bearing points.

The swivel body is preferably coupled with the piston via at least two bearing points and/or with the wobble body via two bearing points and, in fact, preferably via bearing points that are connected in parallel in the power flow, thereby making it possible to attain an advantageous transfer of force using bearings designed to be space-saving in size. The swivel body may be coupled with the piston and/or the wobble body directly or indirectly, via further components.

It is also provided that the swivel body includes at least one and preferably at least two arms that are moved at least partially laterally past the piston, and/or at least one and preferably at least two arms that are moved at least partially laterally past the wobble body, thereby advantageously utilizing lateral installation space and enabling overall length to be reduced.

When the wobble body includes at least two wobble fingers, bearing points that are located in parallel in the power flow may be realized using a simple design and in a space-saving manner, via which a drive force may be transferred from the wobble body to a further component, e.g., directly to the piston, or advantageously, to a swivel body.

Further advantages result from the description of the drawing, below. An exemplary embodiment of the present invention is shown in the drawing. The drawing, the description, and the claims contain numerous features in combination. One skilled in the art will also advantageously consider the features individually and combine them to form further reasonable combinations.

DESCRIPTION OF THE PREFERRED EMBODIMENTS

Figure 1:
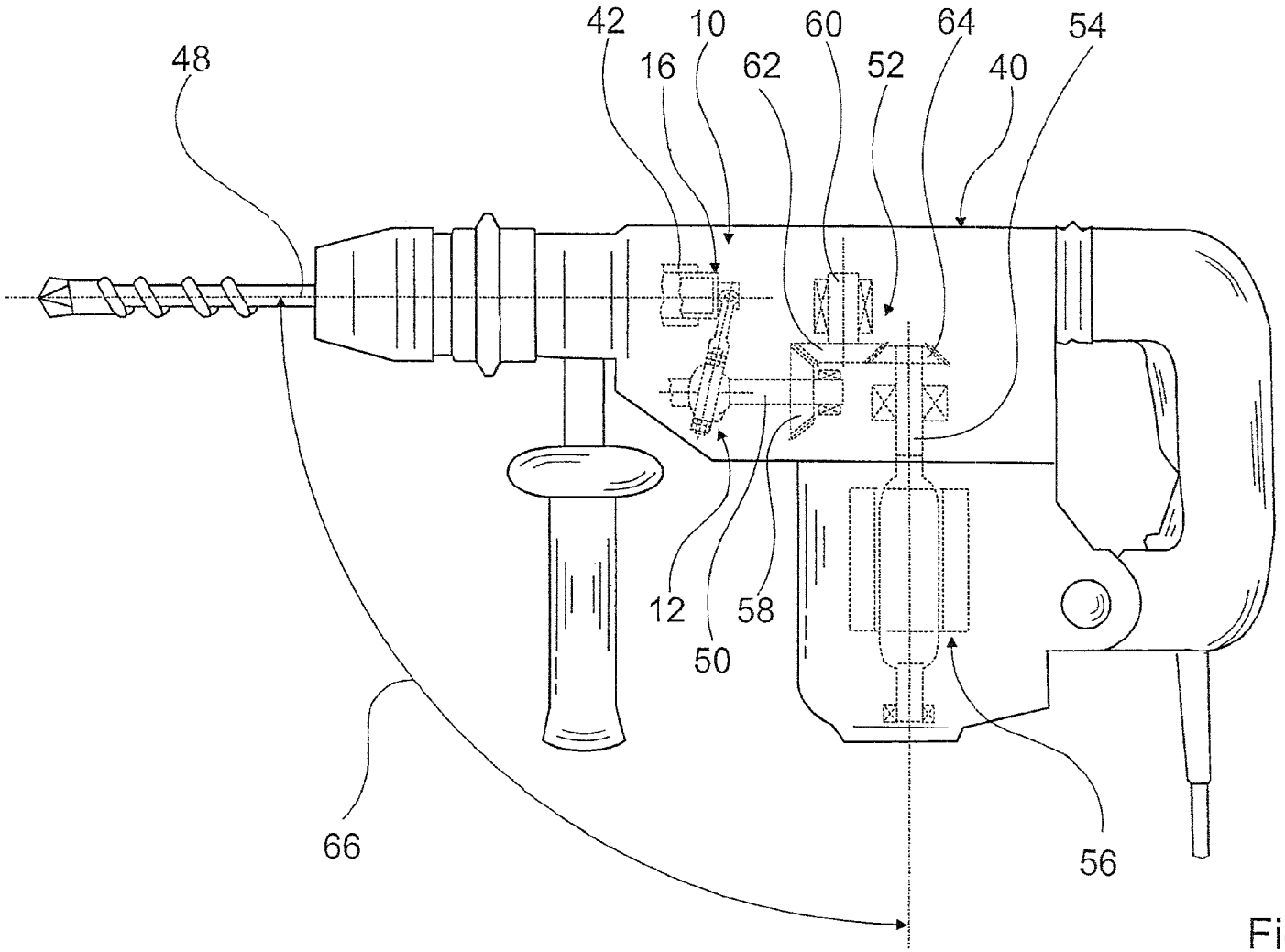
FIG. 1 shows a hand-held power tool, in a side view.
Figure 2:
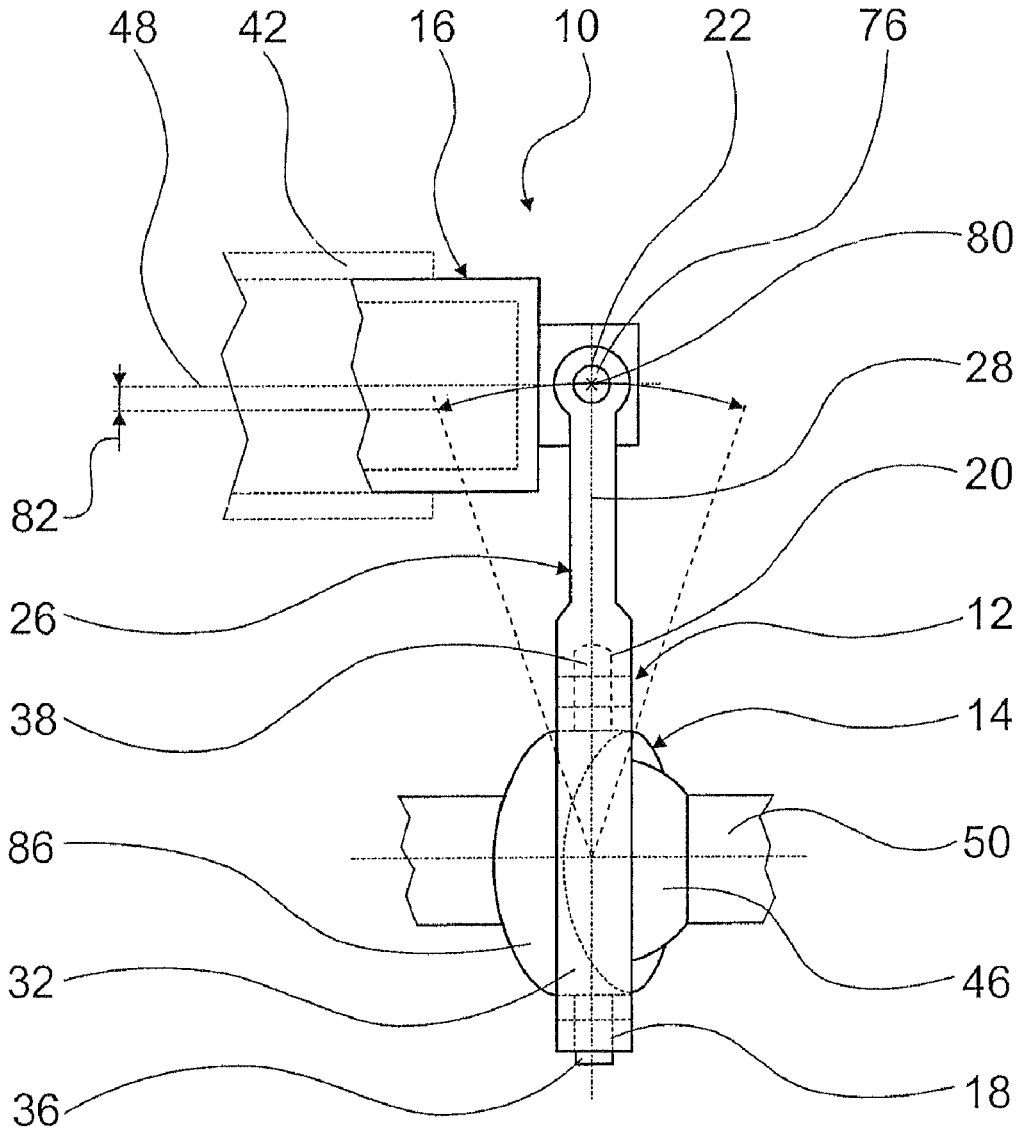
FIG. 2 shows individual parts of a percussion unit of the hand-held power tool in FIG. 1, in a side view.
Figure 3:
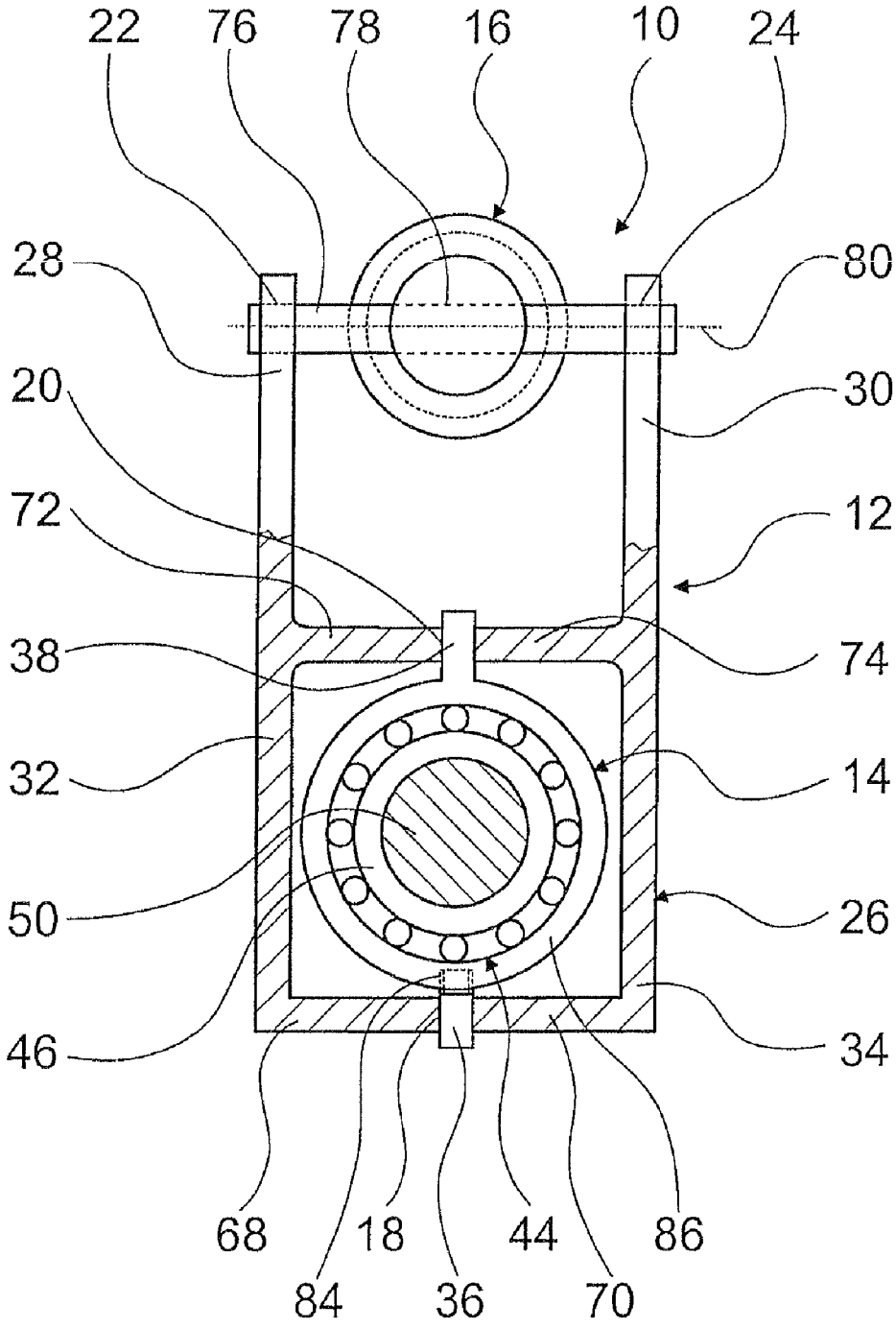
FIG. 3 shows the individual parts of the percussion unit in FIG. 2, in a front view.

FIG. 1 shows a side view of a hand-held power tool designed as a rotary hammer. The hand-held power tool includes a housing 40 and a percussion unit 10 located in housing 40, percussion unit 10 including a wobble bearing unit 12 with a wobble body 14 and a piston 16, which is guided in a translatory manner in a hammer tube 42 (FIGS. 1 and 2). Wobble body 14 is supported obliquely on bearing means 46 via a roller bearing 44, bearing means 46 being non-rotatably mounted on a shaft 50 that extends parallel to hammer tube 42 and/or percussion axis 48 (FIGS. 2 and 3). Shaft 50 is coupled via a toothed gearing 52—which is designed as a bevel gear—with a motor shaft 54 of an electric motor 56 of the hand-held power tool. Toothed gearing 52 includes a first bevel gear 58, which is non-rotatably mounted on shaft 50, and which meshes with a second bevel gear 62, which is supported on one side via an axle 60. Second bevel gear 62 meshes with a third bevel gear 64, which is non-rotatably mounted on motor shaft 54. The hand-held power tool has an L-shaped design, in which motor shaft 54 and its rotation axis, and percussion axis 48 form an angle 66 of 90°. The inventive means of attaining the object of the present invention may basically also be used in other designs that appear reasonable to one skilled in the art, e.g., particularly in designs in which a motor shaft is oriented parallel with a percussion axis.

According to the present invention, the hand-held power tool includes two bearing points 18, 20, 22, 24, which are aligned in parallel in the power flow, and via which wobble body 14 is coupled with piston 16. Wobble bearing unit 12 includes a swivel body 26, which is coupled directly with wobble body 14. Swivel body 26 includes two arms 32, 34, which are moved laterally past wobble body 14. Swivel body 26 is coupled on a side facing away from piston 16 with transverse segments 68, 70 via bearing point 18 with a first wobble finger 36 of wobble body 14, which extends radially away from a main body of wobble body 14. To ensure that installation and removal may be carried out in an advantageous manner, wobble finger 36 is connected via a screw connection 84 with a main body 86 of wobble body 14, and it may be unscrewed from main body 86 of wobble body 14 for installation or removal. Basically, other components may also have a multi-part design, to ensure that installation and removal may be carried out in an advantageous manner.

On a side facing piston 16, swivel body 26 with two further transverse segments 72, 74 is coupled via bearing point 20—which is connected in parallel with bearing point 18 in the power flow—with a second wobble finger 38 of wobble body 14, which is integrally formed with main body 86 of wobble body 14 and extends radially away therefrom.

Swivel body 26 also includes two arms 28, 30, which are guided partially laterally past piston 16, and via which swivel body 26 is coupled via bearing points 22, 24 located on the side next to piston 16 with a transverse bolt 76 that has been guided through piston 16, and via transverse bolt 76 via a bearing point 78 with piston 16. Bearing points 22, 24 are located in parallel in the power flow. As such, the drive force to be transferred to piston 16 during operation is distributed between bearing points 22, 24.

Advantageously, transverse bolt 76 is located fixedly in piston 16, and swivel body 26 is swivelably supported on transverse bolt 76 via bearing points 22, 24. Basically, transverse bolt 76 could also be connected in piston 16 in a swivelable manner, and swivel body 26 could be fixedly connected with transverse bolt 76.

During operation, shaft 50 is driven in a rotating manner using electric motor 56 via toothed gearing 52, and bearing means 46 are driven in a rotating manner via shaft 50. The rotary motion of bearing means 46 results in a wobble motion of wobble body 14, which drives—via wobble fingers 36, 38—swivel body 26 with a swivel motion around a swivel axis 80 that is concentric with transverse bolt 76. The swivel motion of swivel body 26, in turn, results in a translatory, back-and-forth motion of piston 16. Swivel axis 80 always moves along percussion axis 48. Wobble fingers 36, 38 are supported in bearing points 18, 20 such that they may move in their circumferential and longitudinal directions, so that, during operation, wobble fingers 36, 38 may swivel within bearing points 18, 20 around their longitudinal axes relative to swivel body 26, and swivel body 26 may move in the longitudinal direction of wobble fingers 36, 38 relative to them, thereby also making it possible, in particular, to compensate for a height difference 82.

What is claimed is:

1. A hand-held power tool, comprising a percussion unit (10) that includes a wobble bearing unit (12) with a wobble body (14) and a piston (16) guided in a first direction, at least two bearing points (18, 20; 22, 24), which are connected in parallel in power flow, and via which the wobble body (14) is coupled with the piston (16), and a swivel body (26) which is driven by the wobble body and is coupled with the piston, wherein the swivel body (26) has two arms (28, 30) moved at least partially laterally past the piston (16) and coupled via the two bearing points (20, 24) located on sides of the piston (16) with a transverse bolt (76) guided through the piston (16) and via a bearing point (78) with the piston (16), wherein the swivel body (26) has two further arms (32, 34) located adjacent to said first mentioned arms as considered in a second direction which is transverse to said first direction and moved at least partially past the wobble body (14), wherein the swivel body (26) is coupled with first transverse segments (68, 70) spaced from one another in the first direction and with second transverse segments (72, 74) spaced from one another in the first direction and spaced from said first segments (68, 70) in the second direction, wherein said wobble body (14) has a first wobble finger (36) coupled through said first transverse segments (68,70) with said swivel body (26) via a bearing point (18), and a second wobble finger (38) coupled through said second transverse segments (72, 74) with said swivel body (26) via a bearing point (20).

2. The hand-held power tool as received in claim 1, wherein the hand-held power tool is a tool selected from the group consisting of a rotary hammer, a chisel hammer, and both.

* * * * *